US007398766B2

(12) United States Patent
Liskow

(10) Patent No.: US 7,398,766 B2
(45) Date of Patent: Jul. 15, 2008

(54) FUEL RESERVOIR OF A MOTOR VEHICLE FUEL INJECTION SYSTEM

(75) Inventor: Uwe Liskow, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 56 days.

(21) Appl. No.: 11/473,228

(22) Filed: Jun. 23, 2006

(65) Prior Publication Data

US 2006/0288986 A1 Dec. 28, 2006

(30) Foreign Application Priority Data

Jun. 27, 2005 (DE) ..... 10 2005 029 842

(51) Int. Cl.
*F02M 55/02* (2006.01)

(52) U.S. Cl. ..... 123/469

(58) Field of Classification Search ..... 123/456, 123/468, 469

See application file for complete search history.

(56) References Cited

U.S. PATENT DOCUMENTS 5,044,338 A * 9/1991 Shelton ..... 123/469
5,094,211 A * 3/1992 Mahnke et al. ..... 123/463
5,682,857 A * 11/1997 Briggs et al. ..... 123/456
6,286,471 B1 * 9/2001 Powell ..... 123/184.24
6,752,114 B2 * 6/2004 Ochiai et al. ..... 123/184.21
6,817,337 B1 * 11/2004 Siring et al. ..... 123/198 E
6,830,029 B2 * 12/2004 Katayama ..... 123/305
6,912,996 B2 * 7/2005 Kato ..... 123/469

* cited by examiner

*Primary Examiner*—Thomas N Moulis
(74) *Attorney, Agent, or Firm*—Ronald E. Greigg

(57) ABSTRACT

The invention relates to a fuel reservoir of a fuel injection system of a motor vehicle, having at least one fastening portion and one connecting element for fastening to an internal combustion engine, in which the connecting element has at least one first bearing face, which in the installed position points essentially toward the engine, and at least one second bearing face, which in the installed position points essentially away from the engine; and that the fastening portion is received in at least some portions between the bearing faces.

20 Claims, 3 Drawing Sheets

FUEL RESERVOIR OF A MOTOR VEHICLE FUEL INJECTION SYSTEM

CROSS-REFERENCE TO RELATED APPLICATIONS

This application is based on German Patent Application 10 2005 029 842.7 filed Jun. 27, 2005, upon which priority is claimed.

BACKGROUND OF THE INVENTION

1. Field of the Invention

The invention relates to an improved fuel reservoir of a fuel injection system of a motor vehicle.

2. Description of the Prior Art

One fuel reservoir of the type with which this invention is concerned can for instance be part of a common rail diesel injection system or part of a direct gasoline injection system and is also known by the name of "rail". A known rail has one or more fastening portions, with which it can be fastened to the internal combustion engine. The connecting elements are formed by screws, which are screwed into the housing of an engine and tightly fasten the fastening portion between the head of the screw and the shaft that is screwed into the engine housing.

The rail is in communication with fuel injection devices, or injectors which can inject fuel into a combustion chamber of the engine. The injectors are fastened to the engine and can be supplied with fuel from the rail via lines.

From German Patent Disclosure DE 195 46 441 A1, an arrangement comprising a rail and injector is known, in which the injector is received directly in the rail, without using an additional line.

OBJECT AND SUMMARY OF THE INVENTION

With this as the point of the departure, it is the object of the present invention to make a fuel reservoir available that can be produced inexpensively and can be secured to the engine and removed from it equally simply and securely.

It has been found according to the invention that after a relatively long time of engine operation, the rail and/or the fuel injection devices can become stuck to the engine at their contact faces or in their contact regions. For releasing the rail and/or the fuel injection devices from the engine, comparatively strong loosening forces may then be required. At the same time, however, care must be taken to handle the individual components as gently as possible in the process of removing the fuel reservoir and/or the fuel injection devices from the engine.

The connecting element of the fuel reservoir of the invention has a dual function. First, with a first bearing face, the connecting element can firmly tighten the fastening portion of the fuel reservoir to the engine. This first bearing face accordingly acts in the tightening direction. Second, with its second bearing face, the connecting element can function as a removal tool and upon the release of the connecting element can, with this second bearing face, lift the fastening portion off or press it away from the engine. Hence the second bearing face acts counter to the first bearing face.

As a result, one additional special tool can be dispensed with, which reduces the costs for dismantling a rail. At the same time, even with a rail that is "baked hard" onto the engine, simple and reliable dismantling is made possible, without necessitating manual forces that are difficult to adjust. Especially if the injectors are secured directly and rigidly to the rail, damage both to the injectors and to contact faces that are present on the engine are thus avoided.

It is understood that the bearing face need not necessary be designed to be flat and to rest completely on the fastening portion. Still other versions are possible that have only a linear or point-type contact. The only important factor is that the connecting element on the fastening portion be capable of acting in two opposed directions.

The bearing faces are advantageously oriented toward one another, so that depending on the joining direction of the connecting element, the fuel reservoir can selectively either be urged toward or firmly tightened onto the engine, or pulled off or forced away from the engine.

In a feature of the invention, the connecting element has a head region for forming a first bearing face and a shaft region with a radially widened portion for forming a second bearing face. Thus the connecting element can rest with its head region on a first contact face of the fastening portion and can firmly tighten the fastening portion of the fuel reservoir to the engine. With its radially widened portion, the connecting element can form a removal tool. When the fuel reservoir is removed from the engine, the radially widened portion presses against a second contact face of the fastening portion. There is no need to use further tools, and especially expensive special tools.

By means of the fuel reservoir according to the invention, the loosening forces required for removing the fuel reservoir from the engine can be introduced gently, so that the fuel reservoir can be carefully detached from the engine. Especially if the fuel reservoir communicates with a fuel injection device, strong dismantling forces can be built up in a gentle way, to enable loosening the fuel injection device from its firm seat in the housing of the engine.

Introducing loosening forces gently and uniformly over the length of the fuel reservoir is possible especially if a plurality of connecting elements are provided, which are preferably distributed uniformly on the fuel reservoir, so that the loosening forces can be introduced in a plurality of regions and in a uniformly distributed way.

In a feature of the invention, the fastening portion is embodied in flangelike fashion. This makes it possible for the first and second contact faces to be located largely parallel to one another, so that introducing tightening and loosening forces can be done without the connecting element becoming tilted or without the introduction of bending forces.

The fastening portion may have grooves, slits, and/or circumferentially closed through openings for the disposition of the connecting element. The width of the groove or slit or the height of the through opening corresponds in the simplest case to the thickness of the material comprising the fastening portion. The grooves or through openings make it possible to secure the fuel reservoir to the engine in a simple way, with the aid of the connecting element.

In a feature of the invention, the radially widened portion is formed by an annular collar which is nondetachably connected and in particular integrally connected to the connecting element. This annular collar can be produced for instance by suitable cold or hot shaping of a screw blank, or by welding on or press-fitting on of an annular disk.

It is also possible for the radially widened portion to be embodied as a separate element secured to the shaft region, so that a relative motion, above all in the axial direction, between the radially widened portion and the shaft region can be precluded. In such a case, the radial region can be formed for instance by a disk that is press-fitted on or by a self-locking nut that is screwed onto the shaft region.

An advantageous feature of the invention provides that the fastening portion, adjacent to the second contact face, has a receptacle chamber in which the radially widened portion is received at least in some portions, and in particular entirely. This has the advantage that the housing of the engine need not be adapted, since the radially widened portion can be received in the fastening portion.

It is also possible that the housing of the engine has an indentation, in which the radially widened portion is received at least in some portions, and in particular entirely. This version has the advantage that the fastening portion can be made especially low in height, which is advantageous for instance when the installation space in the engine compartment of a motor vehicle is tight.

These advantages become especially important when the fuel reservoir is solidly connected to at least one fuel injection device.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
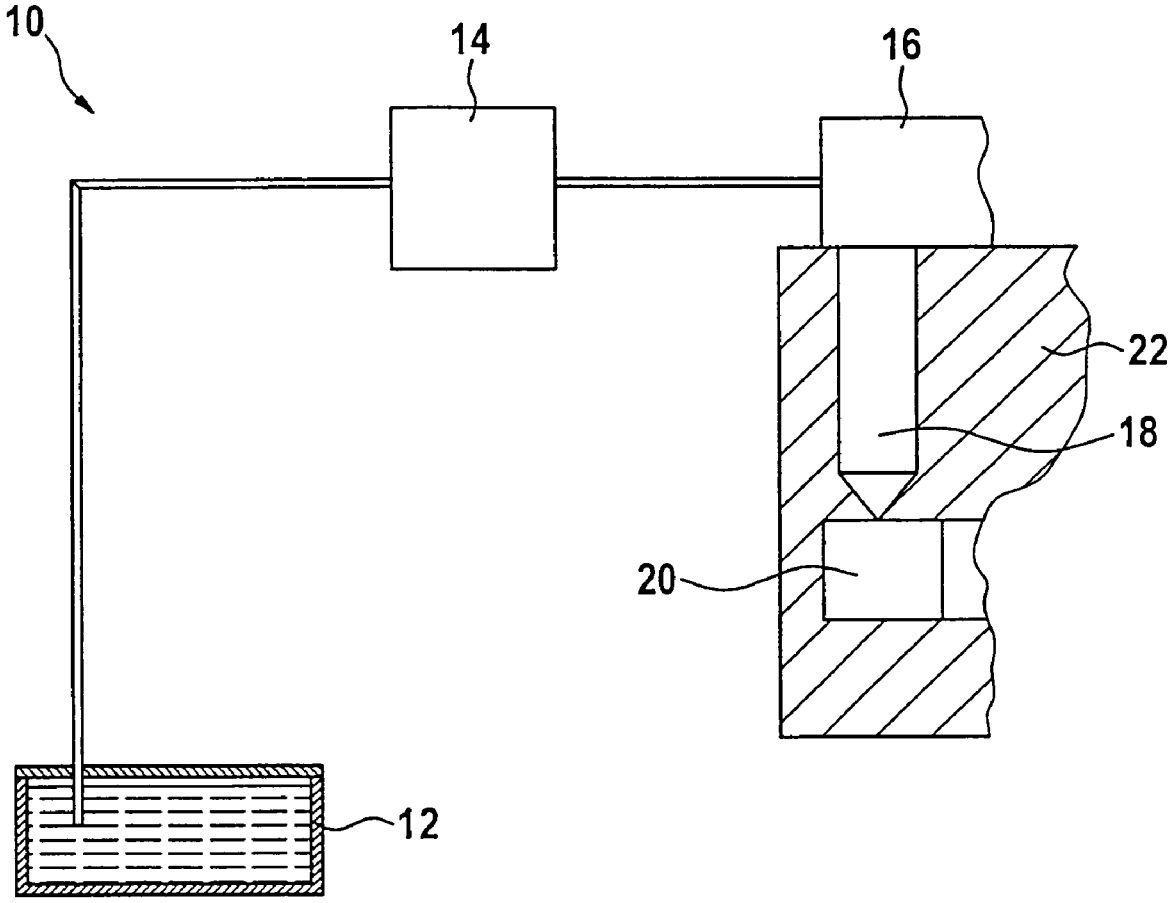
FIG. 1 is a schematic illustration of a fuel injection system having a fuel reservoir and an internal combustion engine.

In FIG. 1, a fuel injection system is identified in its entirety by reference numeral 10. From a fuel collection container 12, the fuel reaches a high-pressure pump 14 and from there a fuel reservoir 16. The fuel reservoir 16 communicates with fuel injection devices 18, of which only one of many fuel injection devices 18 is shown in FIG. 1. The fuel injection device 18 is supplied with fuel through the fuel reservoir 16 and injects the fuel into a combustion chamber 20, shown schematically, of an internal combustion engine 22, also only partly shown.

Figure 2:
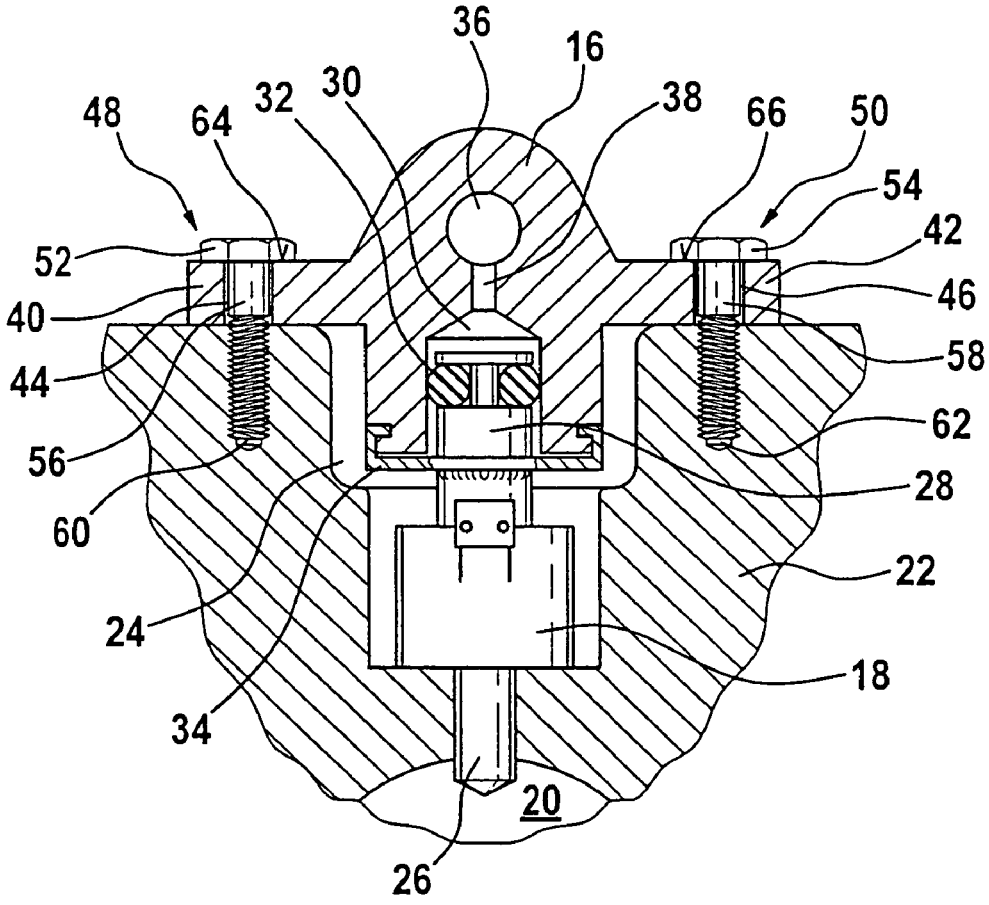
Fig. 2 PRIOR ART
FIG. 2 is a sectional view of the fastening of the fuel reservoir to the engine in the prior art.

The fastening of the fuel reservoir 16 to the engine 22 of the prior art will be described in conjunction with FIGS. 2 through 4. In FIG. 2, a fuel reservoir 16 and an engine 22 of the prior art are shown in section. In the engine 22, a graduated installation space 24 is provided, in which the fuel injection device 18 is received. The fuel injection device protrudes with a nozzle 26 into the combustion chamber 20. On the end diametrically opposite the nozzle 26, the injector head 28 of the fuel injection device 18 is received in a high-pressure chamber 30 embodied in the fuel reservoir 16. The injector head 28 is sealed off from the high-pressure chamber 30 with the aid of a seal 32.

The fuel injection device 18 is solidly connected to the fuel reservoir 16 with the aid of a clamp 34.

The fuel reservoir 16 has a tubular storage chamber 36, which communicates with the high-pressure chamber 30 via a bore 38.

Laterally adjacent to the storage chamber 36, the fuel reservoir 16 has two flangelike fastening portions 40 and 42. Through openings 44 and 46 are embodied in flange portions 40, 42 and connecting elements 48 and 50 reach through these through openings. The connecting elements 48 and 50 have head regions 52 and 54 and shaft regions 56 and 58, respectively. The connecting elements 48 and 50, in their respective shaft regions 56 and 58, are each provided with a male thread (not identified by reference numeral), to enable them to be inserted into corresponding threaded receptacles 60 and 62 embodied in the engine.

The fastening portions 40 and 42 have first contact faces 64 and 66, respectively, facing toward the head regions 52 and 54 of the connecting elements 48 and 50. As a result of the contact of the head regions 52 and 54 with the first contact faces 64 and 66, the fuel reservoir 16 can be firmly tightened to the engine 22.

Figure 3:
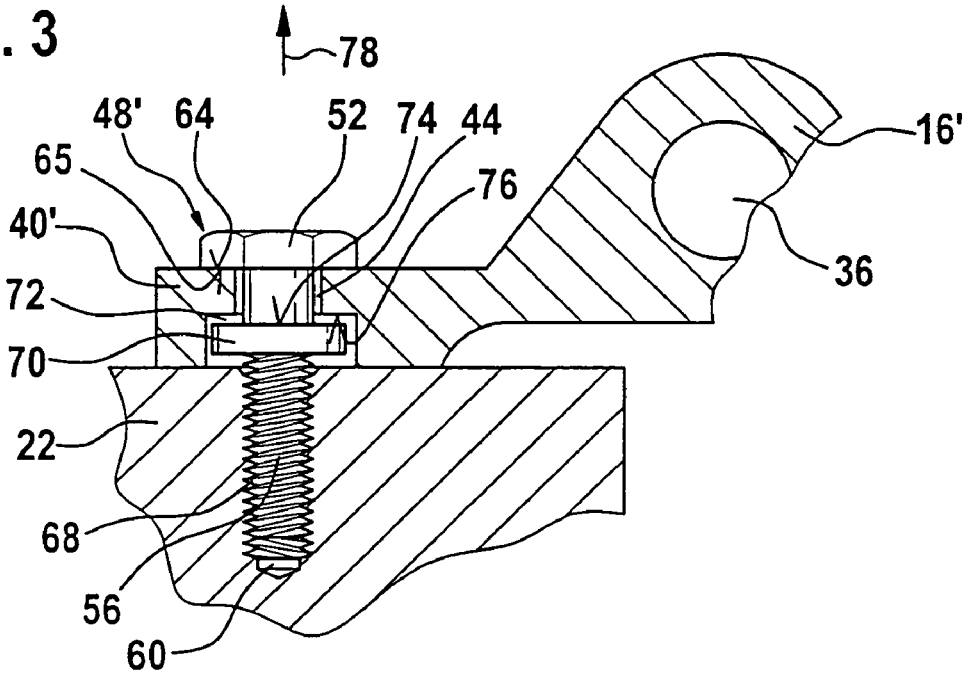
FIG. 3 is a sectional view of a fuel reservoir of the invention is a first embodiment.

In FIG. 3, the arrangement of FIG. 2 is shown, modified according to the invention. The connecting element 48' shown in FIG. 3, like the connecting element 48 shown in FIG. 2, also has a head region 52 and a shaft region 56. On the side toward the engine 22, the head region 52 has a first bearing face 65, which is intended for resting on the first contact face 64 of the fastening portion 40'. The shaft region 56 is provided with a male thread 68, which is suitable for engagement with the receptacle 60 embodied in the engine 22.

On the shaft region 56 of the connecting element 48', a radially widened portion 70 is provided, in the form of an annular collar nondetachably joined to or integrally formed onto the connecting element 48'. The annular collar has an outer diameter that is greater than the diameter of the through opening 44 embodied in the fastening portion 40'. The radially widened portion 70 is received entirely in a receptacle chamber 72 embodied in the fastening portion 40'. The radially widened portion 70 forms an annular second bearing face 74, facing toward the head region 52 and the first bearing face 65.

The face 74 is provided to cooperate with a second contact face 76, embodied on the fastening portion 40', in the following way: If the connecting element 48' is moved out of the engine 22, by being rotated out of the receptacle 70 in the dismantling direction 78, the second bearing face 74 comes into contact with the second contact face 76, so that the fuel reservoir 16 is forced away from the engine 22. As a result of the loosening forces thus generated, a fuel injection device 18, which communicates with the fuel reservoir 16 (see FIG. 2), can simultaneously be pulled out of the engine 22.

Figure 4:
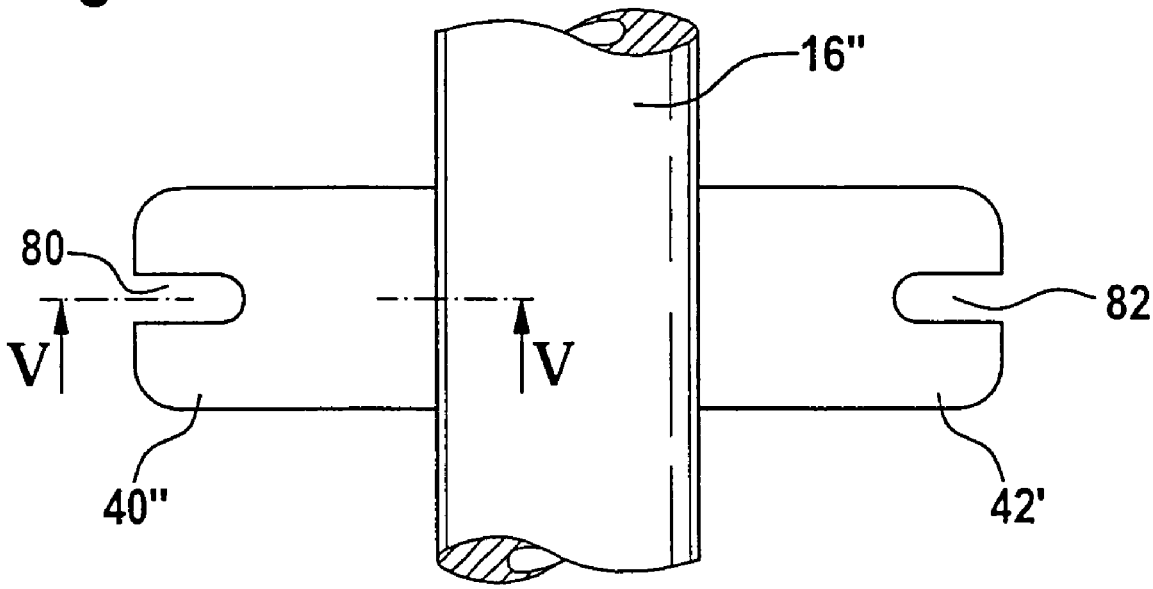
FIG. 4 is a top view on a fuel reservoir in a second embodiment.
Figure 5:
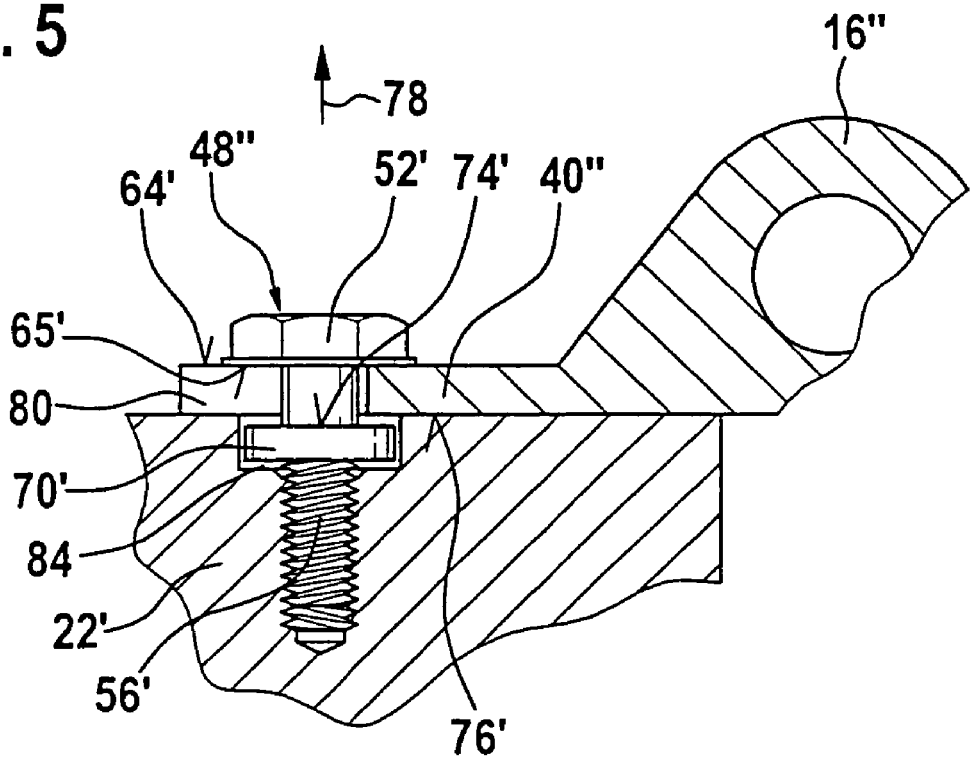
FIG. 5 is a sectional view of the fuel reservoir of FIG. 4, taken along the line V-V in FIG. 4.

FIG. 4 shows a further fuel reservoir 16" with two fastening portions 40" and 42' in a top view. The peripheral region of each of the fastening portions 40" and 42' is provided with a respective slitlike groove 80 and 82. The fuel reservoir 16" can be connected to an engine 22' as shown in FIG. 5. Also in FIG. 5, a connecting element 48" is shown, with which the fastening portion 40" is secured to the engine 22'.

The connecting element 48" has a head region 52' and a shaft region 56'. An annular first bearing face 65' is located on the head region 52'. On the shaft region 56', a radially widened portion 70' is provided, which forms an annular second bearing face 74', facing toward the head region 52'. The radially widened portion 70' is received entirely in an indentation 84 embodied in the engine.

The fastening portion 40" has a first contact face 64', facing toward the head region 52'. The second contact face 76' is located on the diametrically opposite side of the fastening portion 40' and is in contact with the housing of the engine 22'. In the installed state of the fuel reservoir 16", the head region 52'presses with its first bearing face 65' against the first contact face 64', so that the fastening portion 40' is pressed against the engine 22'. Upon removal of the connecting element 48" in the dismantling direction indicated by an arrow 78, the second bearing face 74' of the radially widened portion 70' comes into contact with the second contact face 76' of the fastening portion 40", so that the fuel reservoir 16" is forced away from the engine 22'.

The foregoing relates to preferred exemplary embodiments of the invention, it being understood that other variants and embodiments thereof are possible within the spirit and scope of the invention, the latter being defined by the appended claims.

I claim:

1. A fuel reservoir of a fuel injection system of a motor vehicle, comprising the fuel reservoir having at least one fastening portion (40', 40"), and at least one connecting element (48', 48") for fastening the fuel reservoir to an internal combustion engine, the connecting element (48', 48") having means which can tighten the fastening portion (40', 40") towards the engine, and which connecting element (48', 48"), when loosened, can also push the fastening portion (40', 40") away from the engine, at least one first bearing face (65, 65') on the connecting element (48', 48"), the at least one bearing face (65, 65') in the installed position pointing essentially toward the engine, at least one second bearing face (74, 74') on the connecting element (48', 48") which in the installed position, points essentially away from the engine; and the fastening portion (40', 40") being received in at least some portions between the at least one first bearing face and the at least one second bearing face, so that when the connecting element (48', 48") is tightened towards the engine, the at least one first bearing face (65, 65') engages the at least one fastening portion (40', 40") and the fuel reservoir is thus held tightly to the engine, and when the connecting element (48', 48") is loosened, the at least one second bearing face (74, 74') forces the at least one fastening portion (40', 40") away from the engine.

2. The fuel reservoir as defined by claim 1, wherein the connecting element comprises a head region and a shaft region, the at least one first bearing face being embodied on the head region, and a radially widened portion located on the shaft region and on which the at least one second bearing face is embodied.

3. The fuel reservoir as defined by claim 1, wherein the bearing faces are oriented toward one another.

4. The fuel reservoir as defined by claim 2, wherein the bearing faces are oriented toward one another.

5. The fuel reservoir as defined by claim 1, wherein the fastening portion is embodied in flangelike fashion.

6. The fuel reservoir as defined by claim 2, wherein the fastening portion is embodied in flangelike fashion.

7. The fuel reservoir as defined by claim 1, wherein the fastening portion, for the disposition of the connecting element, has a slot, or a through opening which is closed in the circumferential direction.

8. The fuel reservoir as defined by claim 2, wherein the fastening portion, for the disposition of the connecting element, has a slot, or a through opening which is closed in the circumferential direction.

9. The fuel reservoir as defined by claim 5, wherein the fastening portion, for the disposition of the connecting element, has a slot, or a through opening which is closed in the circumferential direction.

10. The fuel reservoir as defined by claim 2, wherein the radially widened portion is formed by an annular collar which is nondetachably connected to or integrally formed on the connecting element.

11. The fuel reservoir as defined by claim 5, wherein the radially widened portion is formed by an annular collar which is nondetachably connected to or integrally formed on the connecting element.

12. The fuel reservoir as defined by claim 7, wherein the radially widened portion is formed by an annular collar which is nondetachably connected to or integrally formed on the connecting element.

13. The fuel reservoir as defined by claim 2, wherein the radially widened portion is formed as a separate element, secured to the shaft region, in particular as a disk, press-fitted onto the shaft region, or as a self-locking nut screwed onto the shaft region.

14. The fuel reservoir as defined by claim 5, wherein the radially widened portion is formed as a separate element, secured to the shaft region, in particular as a disk, press-fitted onto the shaft region, or as a self-locking nut screwed onto the shaft region.

15. The fuel reservoir as defined by claim 2, wherein the fastening portion, adjacent to the at least one second bearing face, comprises a receiving chamber in which the radially widened portion is received at least in some portions.

16. The fuel reservoir as defined by claim 5, wherein the fastening portion, adjacent to the at least one second bearing face, comprises a receiving chamber in which the radially widened portion is received at least in some portions.

17. The fuel reservoir as defined by claim 7, wherein the fastening portion, adjacent to the at least one second bearing face, comprises a receiving chamber in which the radially widened portion is received at least in some portions.

18. The fuel reservoir as defined by claim 1, wherein the fuel reservoir is solidly connected to at least one fuel injection device.

19. An internal combustion engine, comprising a fuel reservoir as defined by claim 2, the engine including a housing having an indentation in which the radially widened portion is received in at least some portions.

20. An improvement for use with a fuel reservoir of a fuel injection system of a motor vehicle, the fuel reservoir having at least one fastening portion, the improvement comprising:

at least one connecting element (48', 48") for fastening the fuel reservoir to an internal combustion engine, the connecting element (48', 48") having means (68) which can tighten the connecting element towards the engine and also loosen the connecting element from the engine, and which means (68), upon loosening, will push the connecting element away from the engine, at least one first bearing face on the connecting element, the at least one bearing face in the installed position pointing essentially toward the engine, at least one second bearing face on the connecting element which in the installed position, points essentially away from the engine; and the fastening portion being received in at least some portions between the at least one first bearing face and the at least one second bearing face, so that when the connecting element is tightened towards the engine, the at least one first bearing element engages the at least one fastening portion and the fuel reservoir is thus held tightly to the engine, and when the connecting means is loosened, the at least one second bearing face forces the at least one fastening portion away from the engine.

* * * * *